United States Patent [19]

Urdal

[11] Patent Number: 4,866,965

[45] Date of Patent: Sep. 19, 1989

[54] PANIC PROOF PASSAGE LOCK SET

[75] Inventor: Jan Urdal, Hayward, Calif.

[73] Assignee: Schlage Lock Company, San Francisco, Calif.

[21] Appl. No.: 203,065

[22] Filed: Jun. 6, 1988

[51] Int. Cl.[4] ..... E05B 55/04

[52] U.S. Cl. ..... 70/481; 70/DIG. 42; 292/169.17

[58] Field of Search ..... 70/106, 141, 210, 467, 70/471, 473–475, 477, 480, 481, 483, DIG. 42; 292/169.14, 169.15, 169.17, DIG. 62

[56] References Cited

U.S. PATENT DOCUMENTS

| | | | |
|---|---|---|---|
| 2,188,149 | 1/1940 | Kaiser | 70/481 |
| 2,207,801 | 7/1940 | Harp | 70/471 X |
| 2,400,403 | 5/1946 | Falk | 70/481 X |
| 2,544,959 | 3/1951 | Hillgren | 70/483 X |
| 2,723,874 | 11/1955 | Hillgren | 70/481 X |
| 4,453,753 | 6/1984 | Fayerman et al. | 292/347 X |

*Primary Examiner*—Gary L. Smith
*Assistant Examiner*—Douglas E. Ringel
*Attorney, Agent, or Firm*—Walter C. Vliet

[57] ABSTRACT

Disclosed is a lock set for installation in a bored hole in a door having an inside thumb turn locking mechanism. A unique combination camming device, operated by both the thumb turn and independently by the internal spindle through the internal handle, permits inside privacy with a panic proof feature while simultaneously allowing emergency entrance through secondary outside function with an independent means such as a coin or screwdriver.

11 Claims, 3 Drawing Sheets

PANIC PROOF PASSAGE LOCK SET

BACKGROUND OF THE INVENTION

A common experience with passage locks, particularly with children and those of advanced age, is either accidental locking or intentional locking, without understanding of how to unlock the type of lock commonly referred to as a passage lock, wherein a degree of privacy is afforded a secured area, such as a bathroom or a bedroom. The sensation of being locked in a room can be frightening, if not life threatening, and it is common for passage locks to be provided with a means of opening the lock from the exterior by means of readily available secondary implements such as coins, keys, screwdrivers, and the like.

The present invention, although it contains such provisions, also substantially reduces the likelihood of being locked in by virtue of the panic proof feature of the present lock. The lock may be secured from the inside by means of a conventional thumb turn. However, in addition to unlocking by means of the internal thumb turn, the lock may also be opened by operation of the inside handle, often referred to as a panic proof device.

OBJECT OF THE PRESENT INVENTION

The object of the present invention, therefore, is to provide a panic proof passageway lock for use with locksets which are installed in bored holes and which may be operated by either handles or levers, the lever being preferred, where either aesthetically or due to physical impairment, such a device would be more convenient.

A further object of the present invention is to provide a secondary spring assist for use with lever locks to prevent the common problem of lever droop. A further object is to provide a simple, economical, rugged and reliable passage lock set having a panic proof feature.

These and other objects are obtained in a lock set comprising: A housing for mounting on a door, a locking plug rotatably mounted within the housing in a central bore in the housing, means for securing rotation of the locking plug with relation to rotation within the housing, first cam means for deploying the locking means in relationship to rotation of the first cam means, a secondary driver means operatively associated with rotation of an inner spindle, a secondary cam means being mounted for concentric rotation with the locking cam, and in driving relationship with the locking cam, the driver means effecting rotation of the secondary cam means and the locking cam upon rotation of the inner spindle to effect unlocking of the locking means.

DESCRIPTION OF THE PREFERRED EMBODIMENT

Figure 1:
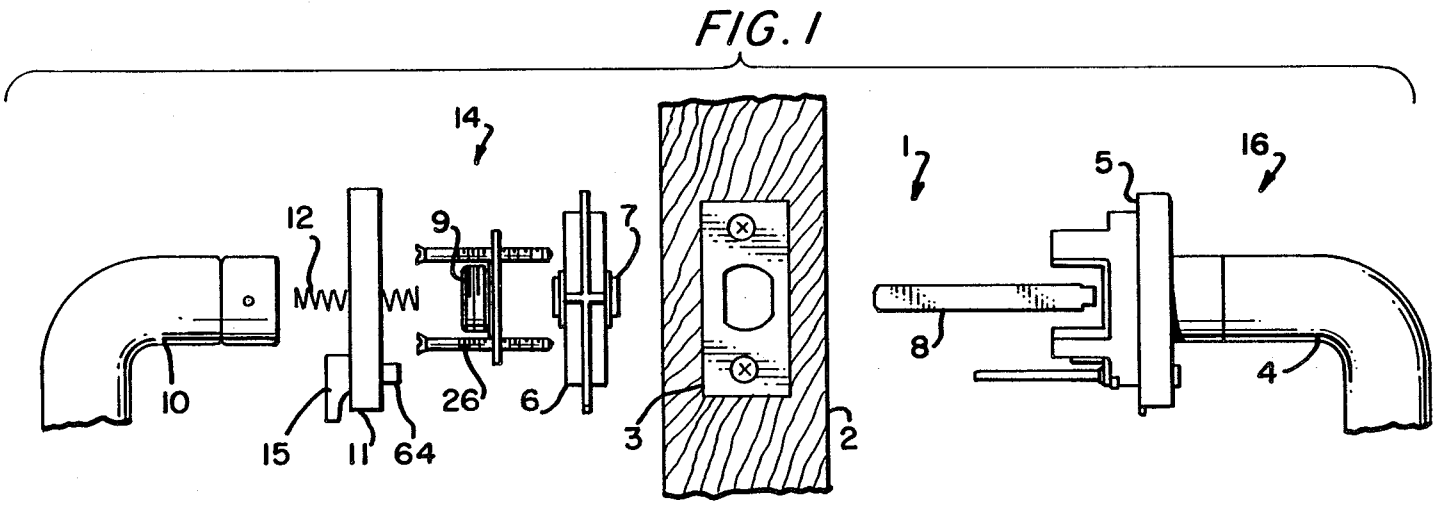
FIG. 1 shows the general assembly of a passage lock according to the present invention showing the major component assemblies.

Referring to FIG. 1, a passage lock assembly according to the present invention is shown in exploded view of the assembly of the major components of the lock generally designated by reference numeral 1. All of the major components with the exception of the latch are assembled through a door hole in the door 2. The latch 3 is assembled through an intersecting bore from the edge of the door in a manner conventional to bored lock sets.

The remaining major components are an outer operating handle or lever 4, the outside housing 5, the spring cage and assembly 6, containing a spindle hub 7, which accepts the inner spindle 8, an inner plate mounting assembly 9, which secures the inside operating handle or lever 10, and the inside rose trim 11 to the door.

Shown mounted on the inside rose trim is a thumb turn 15 having its axis of rotation offset from the axis of rotation of the handle levers by a convenient amount.

A spring 12 preloads the spindle 8 into engagement with the outside housing. Except for the spring cage assembly 6 and thumb turn 15, the inside torsional lock assembly generally designated by the reference numeral 14 is of relatively conventional construction. The function and operation of the spring cage assembly 6 will be described later as well as the function of the thumb turn 15.

Figure 2:
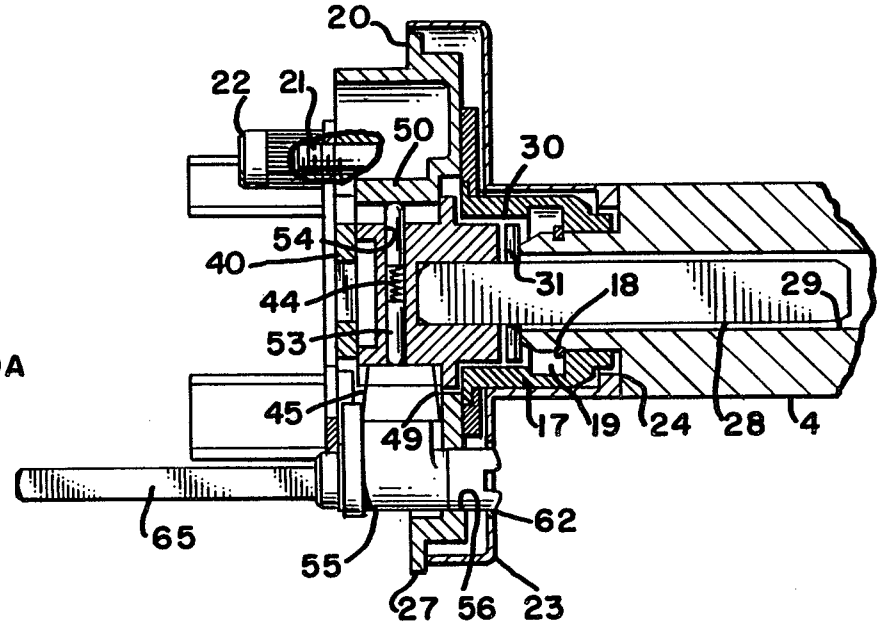
FIG. 2 is a cross sectional plan view of the primary lock housing showing the basic locking mechanism.

Regarding the outside portion of the lock assembly generally designated by the reference numeral 16, outside lever 4 is secured to the outside housing containing the basic locking mechanism as best seen in FIG. 2. FIG. 2 shows the cross section of the outside housing and lever comprising: a lever 4 which is secured to a bushing 17 by means of a retainer ring 18 in a recess 19 within the bushing in a conventional manner for attaching such devices.

The bushing 17 is secured to the primary lock housing 20, by means of mounting fasteners or bolts 21 and knurled nuts 22. The outside trim rose 23 is captured between the outside lever handle 4 and the housing 20 by means of a land 24, and the surface of the door to which the housing 20 is secured. Housing 20 is secured by means of the plate mounting assembly 9 on the opposite or inner side of the door. The mounting plate assembly 9 is secured to the housing 20 by means of mounting bolts 26 best seen in FIG. 1 and FIG. 3. A small projecting tang 27 is used to orientate the trim rose and to prevent its rotation about the housing.

It should be understood that the outside lever 4, is rotatable within the bushing 17, and engages the outside spindle 28, in a square bore 29, such that the square outside spindle 28, is driven by the outside handle, and conversely the outside handle is restrained by the spindle from rotation relative to the spindle. A spindle pin 31 contains the spindle within the bushing 17. The outside spindle engages a locking plug 25 which is rotatably mounted in a bore 30 in the bushing 17 and is oriented for concentric rotation about the spindle in the housing 20.

It should be understood at this point that locking the rotation of the locking plug 25 relative to the housing 20 also prevents rotation of the outside spindle 28 and further the outside lever 4.

Figure 4:
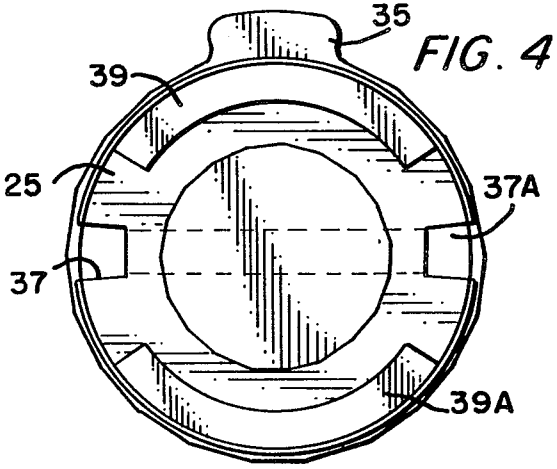
FIG. 4 is an end view detail of the locking plug.
Figure 5:
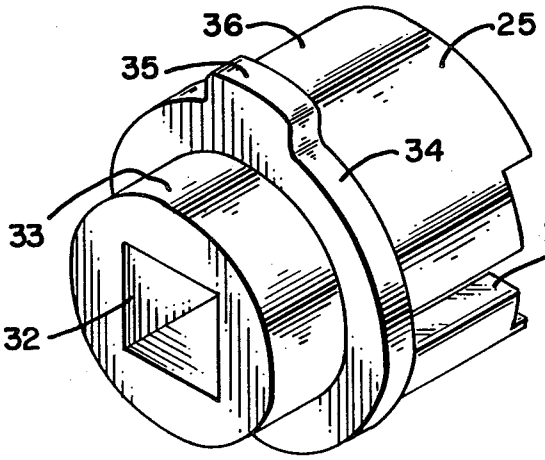
FIG. 5 is a perspective view of the locking plug.

Referring to FIGS. 4 and 5, details of the locking plug 25 are shown including the square outside spindle bore 32, the circular bearing surface 33, which cooperates with bore 30 in bushing 17, a rotation limit ring 34 having a rotation limit stop 35 which is attached to the locking plug or in the alternative formed as part of the locking plug.

Figure 6:
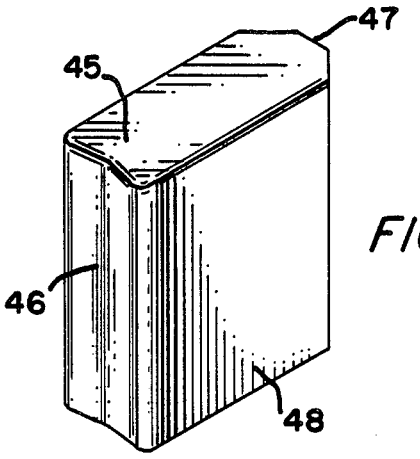
FIG. 6 is a perspective view of the lock bar according to the present invention.
Figure 7:
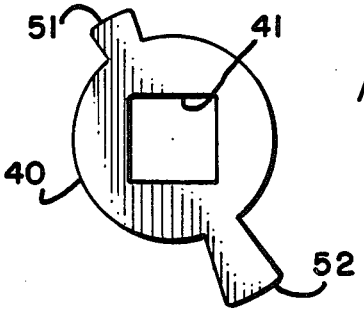
FIG. 7 is a plan view of the insert driver according to the present invention.
Figure 8:
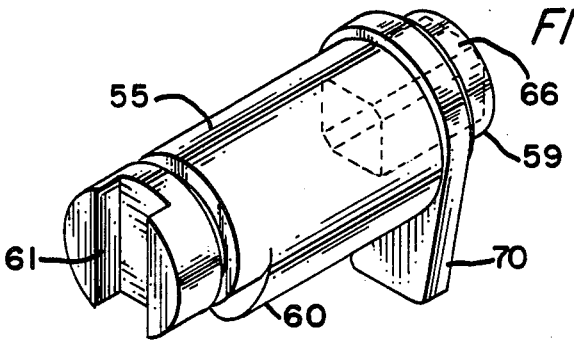
FIG. 8 is a perspective view of the locking and secondary cam device according to the present invention.

Bearing surfaces 36 are shown which cooperate with the housing to guide the rotary motion of the locking plug. The locking plug is also provided with a lock bar slot 37 and two semicircular projecting bosses 39 and 39A, best seen on FIG. 4. The projected bosses 39 and 39A, cooperate with a driver 40, having a spindle bore 41 best seen on FIG. 3. The function of the driver as a first operating means will be described later. A lock bar 45, shown in detail in FIG. 6, is provided with a cam surface 46, a locking plug surface 47, two ends (unnumbered) and a guide surface 48 which cooperates with as radially disposed slot 49, provided in the inner web 50 of the housing 20.

The radially disposed slot 49 guides the lock bar 45 in movement radially inward and outward on guide surfaces 48 to a position wherein the lock bar engages the lock bar slots 37 or 37A provided in the peripheral surface of the locking plug 25 to an alternatively radially outward position wherein the lock bar 45 is out of contact of the lock bar slots 37 or 37A.

It should be understood that when the lock bar 45 is in the radially inward position, engaging the lock bar slot 37, that the locking plug 25 cannot rotate relative to the housing and the outside lever is thereby in a locked position. It should also be understood that only one lock bar 45 is provided and the alternative slots and bosses 49, 49A and 37, 37A, and 39, 39A are provided only to effect left and right hand alternatives in the preferred construction.

Referring again to FIGS. 2 and 3 the projecting bosses 39 or 39A of the locking plug 25 engage a balance lug 51 and a secondary cam driver lug 52. The drive slot formed between projecting boss 39 and 39A being of greater width than the balance lug 51 and the secondary cam driver lug 52 provides a limited loss motion capability in the rotation of the driver 40 relative to the locking plug 25. The purpose of this will soon be understood.

At this point it should be understood that the spring and cage assembly 6, preloads the hub 7, against a stop for rotation in the counterclockwise direction as viewed from the inside of the door, while permitting clockwise rotation against the spring in clockwise rotation. The preloading of the spring against the stop prevents lever droop and returns the inside and outside levers to the horizontal position wherein the latch 3 is in its extended position in a conventional manner.

Figure 3:
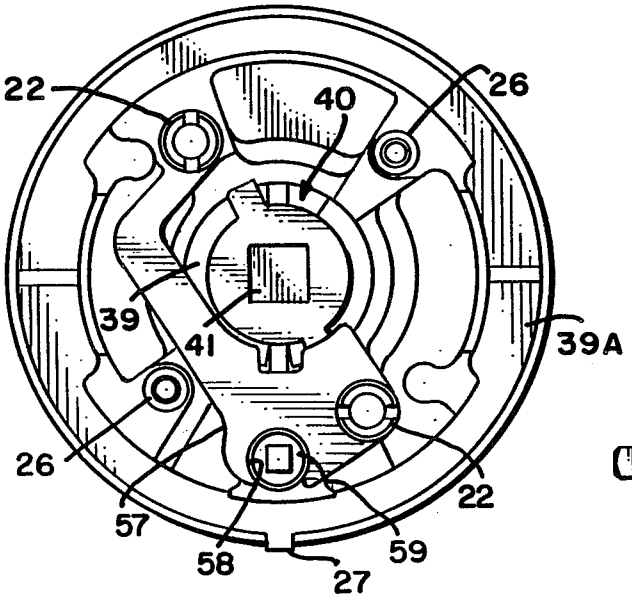
FIG. 3 is an end view of the assembly shown in FIG. 2.

It should be understood that rotating the inside handle in a counterclockwise fashion for the hand shown by the orientation of the parts in FIGS. 2 and 3 will retract the latch. A feature of the lock is its reversibility and it should be understood that reversibility is accomplished by reversing parts such as the insert driver, the locking plug 25 having mirror image lock bar slots 37 and 37A in the housing, etc.

Referring again to FIGS. 2 and 3 the unique panic proof feature of the present locking device will now be described. The function of the lock bar 45 has already been described. Push pins 53 are inserted in a cross bore 54 in the locking plug 25 and are urged to their radial outward position by means of a spring 44. The purpose of the push pins are to urge the lock bar 45 to its radially outward or unlocked position.

A rotary locking cam 55 is disposed in an offset bore 56 in the housing 20 for rotation therein. The locking cam 55 is retained in the offset bore 56 by a brace 57 having a partial bore 58 which engages a bearing surface 59 of an extension of the locking cam 55.

As may be appreciated by one skilled in the art the locking cam 55 is free to rotate in the housing and in the partial bore 58 about a parallel but offset axis to the spindle and locking plug bores. It may be appreciated by one skilled in the art that rotation of the locking cam 55 will engage the throw portion of the cam 60 with the cam surface 46 of the lock bar 45 and thereby urge the lock bar into engagement with the lock bar slots 37 in the locking plug 25. Conversely, rotating the locking cam to the low point of the cam will allow the lock bar 45 to be displaced radially outward by the urging of spring 44 to its unlocked position.

Rotation of the locking cam is accomplished by one of three means. The simplest and most direct is by means of rotating the third operating means or emergency operating notch 61 by means of a coin, screwdriver or the like. Access to the emergency notch is accomplished through a bore 62 in the outside rose trim 23. Rotation of the locking cam 55 can also be accomplished by means of interlocking bar 65 which is turned by means of thumb turn 15 through a transformer 64 which is provided With a square bore (not shown) to drive the interlocking bar 65 disposed within a square bore 66 in the end of the locking cam 55. In this manner the thumb turn may be utilized to rotate the locking cam and thus lock the lock in a normal locking function.

The panic proof feature of the present invention is provided by rotation of the inner handle in a clockwise (FIG. 3 configuration) manner. The handle will rotate the inner spindle 8 which will open the door through its direct connection with latch 3 and in addition, rotate the insert driver 40 through an arc permitted by the lost motion device previously described.

In addition, secondary cam driver lugs 52 will contact the secondary cam 70 on the locking cam 55 causing it to rotate and thereby permitting the lock bar 45 to be urged out of its locking position by the urging force of the spring 44. Thus, the rotation of the inner handle will both accomplish the opening of the door and the unlocking of the locking plug 25 and the outside lever 4 thereby permitting the door to be open and remain unlocked.

Having described my invention in terms of preferred embodiment I do not wish to be limited in the scope of my invention except as claimed.

I claim:

1. A lock set comprising: a lock housing for mounting on a door an inner operating handle and an outer operating handle mounted for rotation about said lock housing; a locking plug rotatably mounted in a bore within said housing for effecting a locking and unlocking function upon rotation; means for preventing rotation of said locking plug within said housing; first cam means for deploying said means for preventing rotation of said locking plug in response to rotation of said first cam means; a secondary driver means operatively associated with rotation of an inside spindle for operatively driving a secondary cam means; said secondary cam means being mounted for concentric rotation with said first cam means, and in driving relationship with said first cam means; said secondary driver means effecting rotation of said secondary cam means and thereby said first cam means upon rotation of said inside spindle to effect rotation of said locking and unlocking plug; said lock housing is further provided with and outside spindle independently mounted and separated from said inside spindle for rotation in the lock housing; said locking plug being in driving engagement with said outside spindle and said outer operating handle connected wherewith; and said means for preventing rotation of said locking plug within said housing comprises a lock bar having radial linear displacement in and out of engagement with said locking plug wherein in its radially inward position it interferes with rotation of said locking plug and in its radially outward position it allows rotation of said locking plug.

2. A lock set according to claim 1, wherein: said first cam means comprises a rotary cam mounted for rotation about a cam axis parallel to but offset from the axis of the outside spindle.

3. A lock set according to claim 2, wherein: said secondary cam means is mounted for rotation about the axis of said first cam means and is in driving relation therewith such that rotation of said secondary cam means effects rotation of said first cam means and thereby deployment of said lock bar.

4. A lock set according to claim 3, wherein: a first operating means is provided for deploying said secondary cam means comprising said secondary driver means being driven by said inside spindle and having lost motion between said secondary driver means and said locking plug to permit said secondary driver means to operate said second cam means and said locking plug.

5. A lock set according to claim 4, wherein: said secondary driver means further comprises a disc having a noncircular drive bore therethrough for cooperation with said inside spindle; and a lug on its periphery for driving cooperation with said locking plug.

6. A lock set according to claim 5, wherein: said driving lug of said secondary driver means cooperates with a pair of spaced bosses on said locking plug.

7. A lock set according to claim 6, wherein: said locking plug is further provided with a rotation limit stop for cooperation with said housing to limit rotation of said locking plug and said outside spindle.

8. A lock set according to claim 3, wherein: said first cam means and said secondary cam means are mounted for rotation about the same cam axis; said cam axis being offset but parallel to the axis of rotation of both the inside spindle and the outside spindle.

9. A lock set according to claim 1 further comprising: a third cam operating means for deploying said first cam means in emergency from the outside of said housing.

10. A lock set according to claim 1, wherein: a spring cage assembly cooperates with said inside spindle to resiliently position said inside spindle.

11. A lock set according to claim 10, wherein: said spring cage assembly further cooperates to resiliently position the outside spindle through driving engagement with said secondary driver means and said locking plug; and said locking plug being in driving engagement with said outside spindle and said outer operating handle.

* * * * *